United States Patent [19]

Knoll

[11] Patent Number: 4,763,835

[45] Date of Patent: Aug. 16, 1988

[54] RAIL CONNECTING AND ALIGNMENT DEVICE

[76] Inventor: Joseph Knoll, Box 244, Gaylordsville, Conn. 06775

[21] Appl. No.: 906,506

[22] Filed: Sep. 12, 1986

[51] Int. Cl.[4] ..... E01B 11/56

[52] U.S. Cl. ..... 238/205; 238/339

[58] Field of Search ..... 238/187, 188, 209, 218, 238/155, 339, 321, 195, 205, 169, 154

[56] References Cited

U.S. PATENT DOCUMENTS

| | | | |
|---|---|---|---|
| 102,043 | 4/1870 | Rose | 238/187 |
| 173,541 | 2/1876 | Hodgdon | 238/209 |
| 695,112 | 3/1902 | McWillie | 238/205 |
| 985,688 | 2/1911 | Martin | 238/188 |
| 1,104,694 | 7/1914 | Milton et al. | 238/218 |
| 1,302,026 | 4/1919 | Fether | 238/188 |
| 2,439,593 | 4/1948 | Young | 238/188 |

FOREIGN PATENT DOCUMENTS

| | | | |
|---|---|---|---|
| 476845 | 12/1952 | Italy | 238/187 |
| 9580 | of 1842 | United Kingdom | 238/339 |
| 13158 | of 1850 | United Kingdom | 238/339 |
| 11446 | of 1895 | United Kingdom | 238/188 |

*Primary Examiner*—Robert B. Reeves
*Assistant Examiner*—Donald T. Hajec
*Attorney, Agent, or Firm*—Joseph R. Carvalko, Jr.

[57] ABSTRACT

There is a rail connecting and alignment device for a railway track disclosed for interconnecting I-shaped rail members. The connecting and aligning device is vertically supported on rail ties, and in turn supports the I-shaped rail member which may lie such that abutting ends are located over a space between rail ties, and the abutting ends are located within the connecting members.

The present invention is concerned with the alignment and connection of railway track. More specifically, the invention is an improvement relating to a rail connecting and alignment device for a railway track and for interconnecting I-shaped rail members which constitute the track. There is a plurality of spaced apart rail tie members, which normally lie upon a rail tie support bed. The tie members are able to support the railway track. A device is provided for vertically supporting a series of the I-shaped rail members so that abutting ends of the rail members may be located over a span between the spaced apart rail tie members. The rail members are maintained in substantial axial alignment, regardless of weight being applied to the vertically supporting device. There is a device which interconnects pairs of the vertically supporting device so as to maintain a predetermined lateral spacing between the I-shaped rail members along desired length of the railway track.

1 Claim, 2 Drawing Sheets

RAIL CONNECTING AND ALIGNMENT DEVICE

FIELD OF THE INVENTION

The present invention relates to the assembly and alignment of railway track members and the connecting of the rail members when the ends of the rail members are located between spans of supporting tie members.

BACKGROUND OF THE INVENTION

In the recent past, the prior art has termed devices which hold or constrain the railway members in place as "anchors". There are a number of such "anchor" devices fully explained in patent references. For example, U.S. Pat. No. 4,289,274, issued to R. Hudson, Sept. 15, 1981 for "RAIL TRACK", concerns the utility of a device which permits assembly of rail tracks without the use of bolts. The Hudson patent teaches that the rail tracks may be fitted with a secured device at the ends, and a cooperating bored hole permits the further attachment of a grooved part which locks the rails together. Suitable hardware then locks the grooved part to the secured device. It is pointed out that the referenced patent requires that a considerable amount of parts, and machining be done for proper assembly. Further, it is not understood how to support the rail track members when the abutting ends of the rail members are positioned over a space between rail tie members.

Another reference patent is U.S. Pat. No. 3,358,926, issued Dec. 19, 1967 to W. Blackford for "RAIL ANCHOR". The Blackford patent is concerned with gripping the rail member. There is an engineering concern when the prior art is considered wherein, the design of such locking and joining members would best be carried out with a symmetrical cross section, so as to evenly distribute vertical loading imposed on the rail members. In retrospect, it is with the foregoing prior art in mind that the present invention is hereby presented, with a view towards improving the connections of rail members as well as their support.

SUMMARY OF THE INVENTION

The present invention is concerned with the alignment and connection of railway track. More specifically, the invention is an improvement relating to a rail connecting and alignment device for a railway track and for interconnecting I-shaped rail members which constitute the track. There is a plurality of spaced apart rail tie members, which normally lie upon a rail tie support bed. The tie members are able to support the railway track. A device is provided for vertically supporting a series of the I-shaped rail members so that abutting ends of the rail members may be located over a span between the spaced apart rail tie members. The rail members are maintained in substantial axial alignment, regardless of weight being applied to the vertically supporting device. There is a device which interconnects pairs of the vertically supporting device so as to maintain a predetermined lateral spacing between the I-shaped rail members along desired length of the railway track.

The invention further relates to details of an elongated member, having a substantially [___] shaped cross section adopted to fit closely over a lower portion of the I-shaped rail members, such that an inside horizontally disposed surface of the elongated member lies directly beneath a lower, horizontally disposed surface of the I-shaped rail members, thereby maintaining vertical support of the I-shaped rail members when they are subjected to overlying load. A pair of spaced apart flanges are formed at opposing longitudinal ends of the elongated member, so that each of the flanges projects downwardly at a substantial right angle with respect to the lower portion of the rail member in order to locate the elongated member longitudinally against one substantial vertical side of a first and a second tie member of the tie members. The spaced apart flanges each have an auxiliary flange formed therefrom to enable engagement of the interconnecting device at the opposing longitudinal ends of the elongated members which are disposed in parallel relationship.

Therefore, having given a summary of the present invention, it is a primary object of the invention to provide an improved way of supporting rail members which have abutting ends which may lie over a space between rail tie members.

It is another object of the present invention to provide a way of maintaining vertical support of the rail members while also maintaining the rail members in spaced, parallel relationship to each other.

It is yet another object of the present invention to provide a connecting and alignment device for rail members which is substantially uniform in cross section, in order to resist twisting.

It is a further object of the present invention to provide a connecting and alignment device which is readily adaptable to existing rail tracks having I-shaped rail members. Therefore having briefly described some of the objects and advantages of the present invention, a brief description of the drawings follows.

DESCRIPTION OF THE PREFERRED EMBODIMENT

Figure 1:
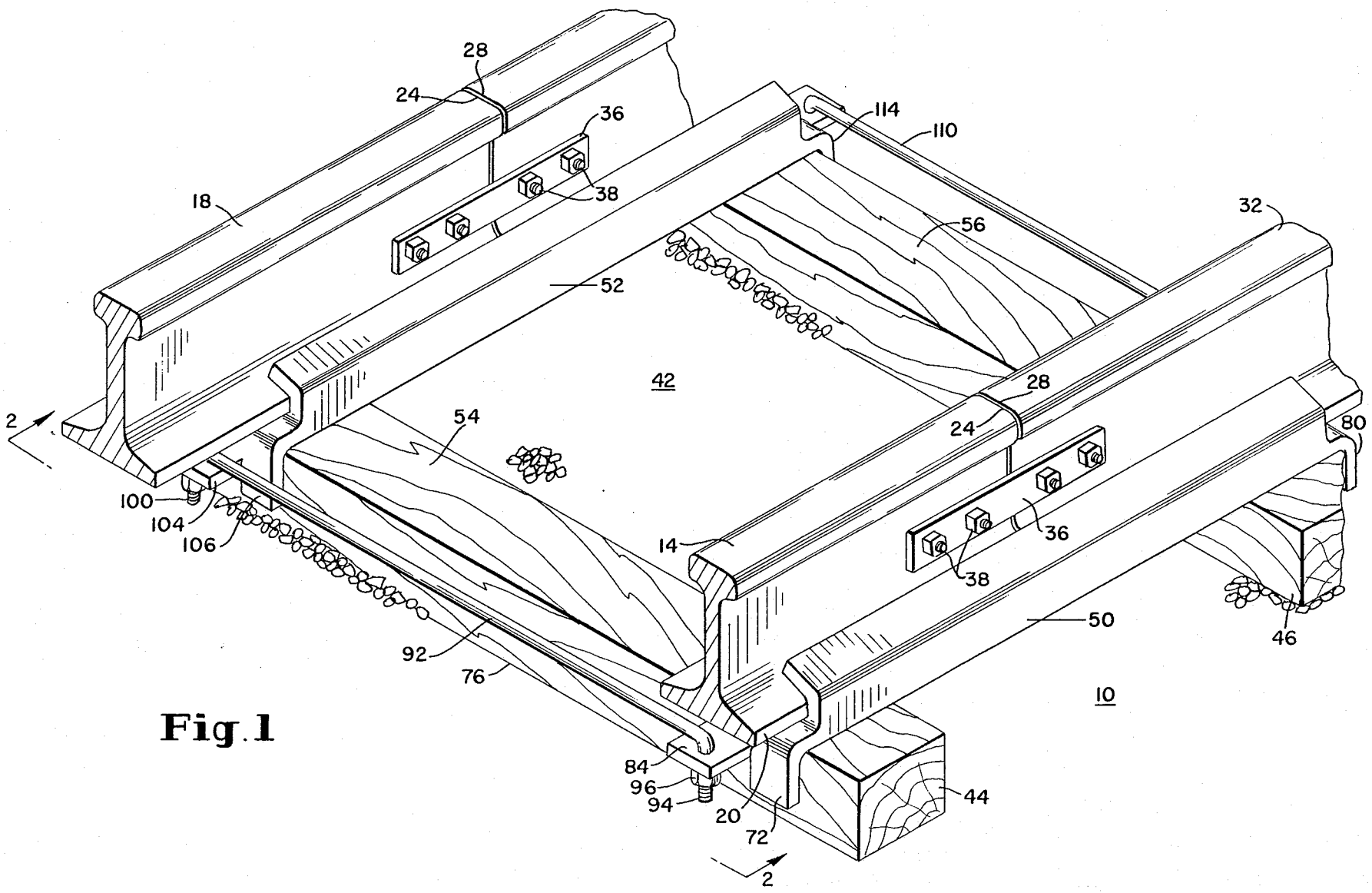
FIG. 1 is an isometric view of a railway track, which is formed of two I shaped rail members, lying on the connecting and alignment device of the present invention, which in turn is supported by space apart tie members and an appropriate rail tie bed.
Figure 2:
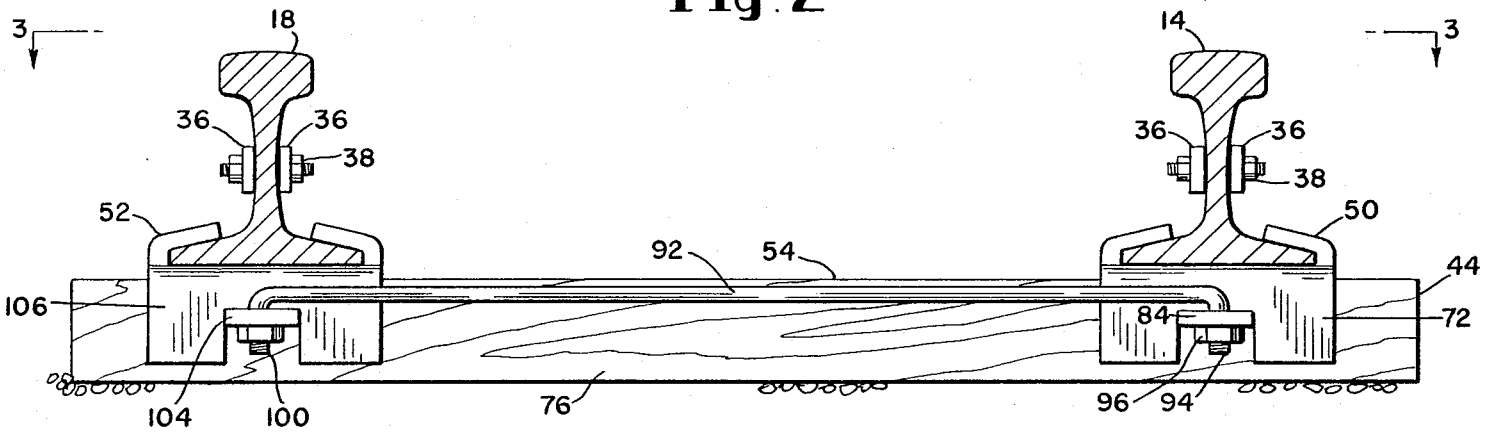
FIG. 2 is a plan view taken along the lines of 2—2 intersection from FIG. 1, showing an end view of the rail members, and the connecting and alignment device of the present invention.

Referring to the accompanying drawings, and especially FIG. 1, there is a segment 10 of a railway track illustrated. The drawing is broken, since it will be appreciated that it will not be necessary to show more of a railway track than is necessary to define the present invention in the particular environment for which it is suited.

There is an I-shaped rail member 14, and a second similar shaped member 18 which are laterally spaced to accommodate the standard railway car wheel spacing. The rail member 14 has a lower, horizontally disposed surface 20, which constitutes the major load supporting surface of the member 14. The member is essentially symmetrical, as is well known, and is of a standard length, having an end 24 which lies abutting an end 28 of an aligned rail member 32. There is a suitable strap member 36, which is used to tie the rail members 14 and 32 through suitable bolts like a bolt 38, which pass through appropriate holes in the members 14 and 32.

Beneath all of the structure defined heretofore, there is a railway bed 42, and there is a rail tie member 44 and 46, which are suitably reinforced by the bed 42, and there is a rail connecting and alignment device 50 and a similar member 52, both of which are directly supported by a substantially horizontal surface 54 and 56 of tie members 44 and 46 respectively. The members 50 and 52 are elongated, and have a substantially [___] shaped cross section which is formed from a suitable steel working process to provide a uniform part. The detail of the cross section of the member 50 may be seen in more detail in FIG. 4 where it is seen that there is an inside, horizontally disposed surface 60, which connects to a right angle leg 62 and 64. The legs 62 and 64 in turn are connected to a short flange 66 and 68 respectively, the flanges 66 and 68 being substantially parallel to the surface 60. The surface 60 is the main support for vertical loads imposed upon the member 50. The member 52 supports a vertical load through a similar surface (the members 50 and 52 are exactly alike).

Figure 4:
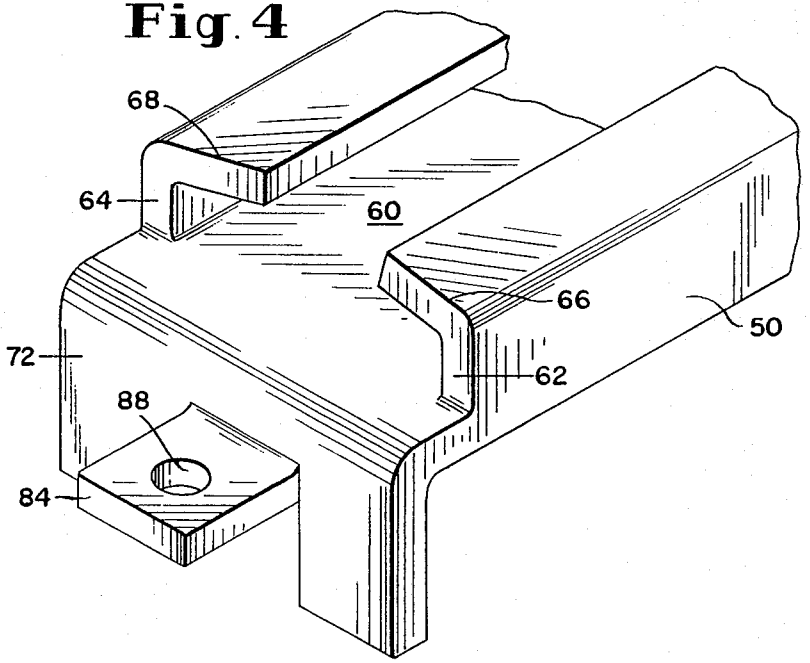
FIG. 4 is a partial isometric view taken along the same lines of FIG. 1 of one end of a connecting and alignment device.

The member 50 has a pair of spaced apart flanges, one of which is shown in FIG. 4. A flange 72 reaches downwardly at a substantially right angle with respect to the horizontal reach 60 of the member 50. In FIG. 1 the flange 72 abutts against a vertical side 76 of the tie member 44. There is a flange 80 which is a mirror image of the flange 72, and which abutts against a vertical side 84 of the tie member 46. Referring back to FIG. 4, there is an auxiliary flange 84, which is bent upwards from the flange 72 in order to lie substantially horizontal and parallel with the surface 60 of the member 50. The auxiliary flange has a suitable aperature 88 for receiving an elongated bar member 92. Referring to FIG. 1, the member 92 is seen having a bent leg 94, which is threaded for engaging a nut 96. There is a similar bent leg 100, and corresponding auxiliary flange 104 bent from a flange 106, of the member 52.

Figure 3:
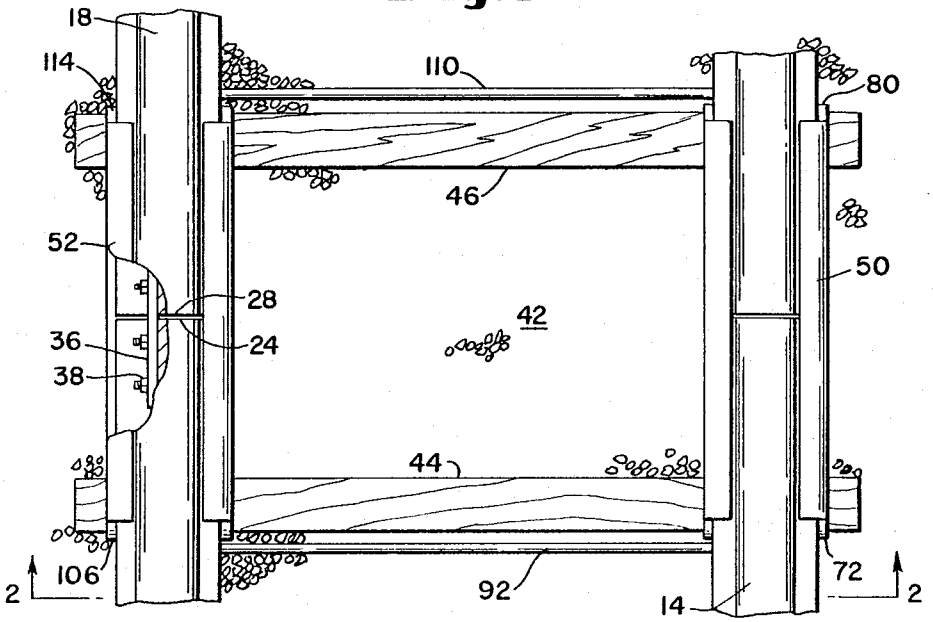
FIG. 3 is a plan view taken along the lines of 2—2, showing a segment of the railway track, and the devices of the present invention.

There is a corresponding bar member 110 (FIG. 3), which is fastened to the flange 80 of member 50, and to another corresponding flange 114 of the member 52. The bar members 92 and 110 are used to maintain parallel relationship of the rail members 14 and 18.

Therefore, having described the preferred embodiment of the invention, the present invention will be better understood, while it is recognized that the present invention may be altered by changing aspects of the detailed parts which will not alter the spirit and scope of the appended claims.

What is claimed:

1. A rail connecting and alignment device for a railway track, said track comprising a pair of spaced apart I-shaped rail members, each rail member formed from a plurality of aligned rail segments having abutting ends, said device for interconnecting said abutting ends of said I-shaped rail members, which constitute said track, said improvement comprising:

a. a plurality of spaced apart rail tie members, which lie upon a rail tie support bed, said tie members being arranged to support said railway track;

b. means for vertically supporting a series of said I-shaped rail members so that abutting ends of said rail members that are located over a span between said spaced apart rail tie members, are maintained in substantial axial alignment, regardless of weight being applied to said vertically supporting means, while said vertically supporting means is supported by said rail tie members; and, c. means interconnecting pairs of said vertically supporting means so as to maintain a predetermined lateral spacing between said I-shaped rail members along a desired length of said railway track;

d. wherein said means for vertically supporting said I-shaped rail members further comprises:

an elongated member, having a cross section which fits closely over a lower portion of said I-shaped rail members, such that an inside, horizontally disposed surface of said elongated member lies directly beneath a lower, horizontally disposed surface of said I-shaped rail members; and, a pair of spaced apart flanges, formed at opposing longitudinal ends of said elongated member, such that each of said flanges projects downwardly at a substantially right angle with respect to said lower surface of said rail members, to permit location of said elongated members longitudinally against one substantially vertical side of a first and a second tie member of said tie members, said spaced apart flanges each further having an auxiliary flange formed therefrom having through holes, to enable engagement of said means for interconnecting at opposing longitudinal ends of said elongated members; and, e. wherein said means for inconnecting consists of bar members, and extends beneath the lower, horizontally disposed surface of said I-shaped rail members; and, wherein each bar member has opposing threaded ends suited for bolting engagement with said auxiliary flanges at each opposing end of the elongated members.

* * * * *